US008777067B2

(12) United States Patent
Trulaske et al.

(10) Patent No.: US 8,777,067 B2
(45) Date of Patent: Jul. 15, 2014

(54) BEVERAGE DISPENSING SYSTEM WITH APPARATUS FOR CONTROLLING FOAMING AND FLOW RATE

(76) Inventors: James A. Trulaske, Town and Country, MO (US); Stephen M. Schmitt, Hazelwood, MO (US)

( * ) Notice: Subject to any disclaimer, the term of this patent is extended or adjusted under 35 U.S.C. 154(b) by 0 days.

(21) Appl. No.: 13/393,422

(22) PCT Filed: Jun. 20, 2011

(86) PCT No.: PCT/US2011/041125

§ 371 (c)(1), (2), (4) Date: Feb. 29, 2012

(87) PCT Pub. No.: WO2011/160137

PCT Pub. Date: Dec. 22, 2011

(65) Prior Publication Data

US 2013/0082075 A1 Apr. 4, 2013

Related U.S. Application Data

(60) Provisional application No. 61/356,412, filed on Jun. 18, 2010.

(51) Int. Cl.

| | |
|---|---|
| ***B67D 3/00*** | (2006.01) |
| ***B67D 1/14*** | (2006.01) |
| *B67D 1/00* | (2006.01) |

(52) U.S. Cl.

CPC ..... *B67D 1/1466* (2013.01); *B67D 1/1405* (2013.01); *B67D 1/0081* (2013.01)

USPC ..... 222/517; 222/511

(58) Field of Classification Search

CPC .. B67D 1/0081; B67D 1/1466; B67D 1/1405; B65D 47/249; B65D 45/2046

USPC ..... 222/511–518, 400.7, 400, 8

See application file for complete search history.

(56) References Cited

U.S. PATENT DOCUMENTS

| | | | | |
|---|---|---|---|---|
| 1,633,642 | A * | 6/1927 | Kramer | 137/322 |
| 3,863,673 | A * | 2/1975 | Sitton | 137/614.11 |
| 4,850,387 | A * | 7/1989 | Bassill | 137/212 |
| 4,930,689 | A * | 6/1990 | Stumpf | 222/487 |
| 4,982,879 | A * | 1/1991 | Corrado et al. | 222/400.7 |
| 5,037,015 | A | 8/1991 | Collins | |
| 5,385,276 | A * | 1/1995 | Yen-Tang | 222/400.8 |
| 6,019,257 | A * | 2/2000 | Rasmussen | 222/400.7 |
| 6,095,379 | A * | 8/2000 | Martinez et al. | 222/402.13 |
| 6,349,858 | B1 * | 2/2002 | Kingsford et al. | 222/400.7 |
| 6,454,142 | B1 * | 9/2002 | Meynet | 222/473 |

(Continued)

*Primary Examiner* — Lien Ngo

(74) *Attorney, Agent, or Firm* — Matthews Edwards LLC

(57) ABSTRACT

The beverage dispensing system includes a dispensing faucet defining a flow path, a valve head in the flow path movable between a closed position in sealed contact with a valve seat, and an open position. An actuator is manually movable to operate the faucet, and a biasing element is cooperable with the actuator and valve head such that an initial movement of the actuator will automatically cause sufficient energy to be stored or loaded in the biasing element for moving the valve head to the open position but without doing so. Occurrence of a subsequent predetermined event such as a further movement of the actuator will cause the stored energy to be automatically released to rapidly or nearly instantaneously move the valve head to the open position. As a result, no instruction or skill is required to operate the faucet to uniformly dispense pressurized beverages such as draught beer.

22 Claims, 16 Drawing Sheets

(56) References Cited

U.S. PATENT DOCUMENTS 6,702,159 B2 * 3/2004 Itou et al. ..... 222/400.7
2002/0074355 A1 * 6/2002 Lewis et al. ..... 222/181.3
2004/0045988 A1 * 3/2004 van der Klaauw et al. ..... 222/400.7

* cited by examiner

American Standard Beer Fauset

18

B
54
B2(20-30%)
B1(70-80%)
A1
51
44
A
20
28
48
60
62
52
22
53
24
30
46
50

BEVERAGE DISPENSING SYSTEM WITH APPARATUS FOR CONTROLLING FOAMING AND FLOW RATE

This application is submitted under 35 U.S.C. 371 claiming priority to PCT patent application Serial No. PCT/US2011/041125, filed Jun. 20, 2011, which application claims the benefit of U.S. Provisional Application No. 61/356,412, filed Jun. 18, 2010.

TECHNICAL FIELD

This invention relates generally to a beverage dispensing system such as a beer faucet for dispensing draught beer, and, more particularly, to a beverage dispensing system including apparatus configured and operable for automatically reducing the foaming of the beverage as it is dispensed, while allowing a user to control flow rate of the beverage.

BACKGROUND ART

Beverage dispensing systems, particularly faucets for the pouring of draught beer or other naturally and/or artificially pressurized beverages, are well known. Typical pressurized beverages such as draught beer, contain a pressurizing medium, which is commonly a gas such as carbon dioxide. This pressurization medium can be naturally occurring, for instance, as a result of a fermentation process, and/or it can be added to the beverage, when made, and/or while in a container or flow line from which it is to be dispensed. Common pressurization levels are between about 10 and about 20 psi.

Typical known faucet constructions comprise a housing or body defining a flow path for the beer or other beverage from a pressurized flow line or container, to a dispensing outlet such as a spout or nozzle. The flow of the beverage is controllable by a hand actuator in connection with a valve assembly, typically having valve barrel or head disposed within the housing along the flow path and including an annular valve surface or gasket, e.g., of a rubbery material, that can be brought to bear against a mating annular valve seat also within the housing and disposed about a portion of the flow path, for creating a sealed condition which will prevent flow of the beverage and maintain the pressurization. In a known construction referred to commonly as an American style faucet, the valve head is disposed in the flow path so as to be at least largely immersed in the beverage in a manner such that the pressurization of the liquid urges the valve head against the valve seat for maintaining the sealed condition, either alone, or in combination with an external force, e.g., exerted by the lever when in its closed position. In this construction, the valve assembly includes a valve stem that extends through a portion of the flow path between the valve seat and a dispensing outlet, to connect the valve head to a lever, handle, or other hand actuator. Most familiar is an upstanding lever disposed above the spout and pivotable relative thereto through a limited range of movement for closing and opening the faucet by moving the valve head via the valve stem, into and out of sealed engagement with the valve seat.

In the known American beer faucet configuration, the faucet housing is oriented about horizontal, with the valve stem also extending horizontally through a portion of the flow path, and the flow path curving down to the spout or nozzle. The valve head will be supported on or comprise one end of the valve stem, which will also be horizontal, and supported for longitudinal horizontal movement along the portion of the flow path within the housing. The lower end of the upstanding lever, handle, etc., will include some kind of connection, such as a ball and socket or fork type pivotal connection, to a second end of the valve stem within the housing, so as to be pivotable for moving the valve stem, and the valve head, longitudinally and horizontally relative to the valve seat.

Essentially, during operation of the known faucets, the actuator, e.g., lever, valve stem, and valve head, are in force transmitting contact, such that forces exerted by the operator through the actuator, e.g., lever, handle, etc., to the valve stem are exerted substantially directly and instantaneously against the valve head, for urging and pushing it in opposition to the pressurization in the beverage line or container, away from the valve seat, at a speed generally governed by the speed of movement of the lever.

Generally, the above described faucet operates well for dispensing carbonated beverages such as beer when used by an experienced operator such as a professional or experienced bartender, but a shortcoming observed to arise, particularly when operated by less experienced persons, is a tendency for the dispensed beer to often contain more than a desired amount of foam. Through observation and investigation, it has been found that one significant source of excessive foaming is opening the faucet too slowly. Apparently, if a faucet is slowly opened, gas, in the form of carbon dioxide naturally occurring in and/or added to beverages such as draught beer, can be released through the valve at a larger than desirable rate, and results in break up of the liquid and excessive foaming condition in the dispensed beverage. This shortcoming can be alleviated in many instances by rapidly manually opening the faucet, but non-professional operators don't typically know this, and, as a result, dispensing is more time consuming, much beer is lost, and customer satisfaction is reduced.

What is sought therefore, is a manner of, and/or apparatus for, dispensing carbonated beverages via a faucet of a dispensing system, particularly, draught beer, and for use by non-professionals, which overcomes the shortcoming set forth above, yet which allows easily controlling flow rate of the dispensed beverage.

SUMMARY OF THE INVENTION

What is disclosed is a beverage dispensing system including apparatus for dispensing carbonated beverages, for example, but not limited to, draught beer, via a faucet or other dispenser, which overcomes the shortcomings set forth above, to provide a consistent, rapid initial opening of the faucet or other dispenser, hereinafter sometimes referred to collectively by the term "faucet" alone, resulting in less foam and improved satisfaction, even when operated by inexperienced or inattentive users.

According to a preferred aspect of the invention, the invention resides in configuring a faucet such that the valve assembly will open sufficiently rapidly, irrespective of the speed of manual movement of the actuator, e.g., lever, handle, or the like, so as to suppress escape of the pressurizing medium, e.g., natural and/or added gas such as carbon dioxide, to an extent sufficient to substantially reduce break up and foaming of the dispensed beverage, while still enabling controlling the rate of dispensing the beverage, and the ability to add a desired foam head to the dispensed beverage.

According to another preferred aspect, the invention utilizes a biasing element disposed in connection with the valve assembly and/or lever of a faucet of existing or new design, which biasing element is configured and automatically operable for resiliently absorbing or storing all or a portion of the energy generated by, and the displacement of, an initial or partial displacement or movement of the lever, handle, or other actuator in a direction for opening the valve, such that any forces that are exerted by the initial or partial movement against the valve head will be marginally inadequate to overcome the opposing force exerted by the pressurization of the beverage holding the valve head in the closed position. As a result, there will be no flow of the beverage through the valve during this initial phase.

After the initial phase, a second or rapid open phase will be automatically initiated by occurrence of a predetermined condition or event, which preferably will comprise continued movement of the lever, handle, or other actuator in the direction for opening the valve, in a manner so as to break the seal between the valve head and the valve seat. When the seal is broken, it is believed that the pressurization in the immediate vicinity of the valve head urging it closed is immediately largely or drastically reduced, and/or pressure conditions acting to open the valve head will immediately appear as a result of flow or seepage of the liquid and/or pressurization medium, e.g., carbon dioxide, between the valve head and the valve seat, so as to begin to counteract and even possibly exceed the pressure urging the valve head closed. As a result, application of a small external or additional force against the valve head in a rapid and direct manner, such as is possible through the release of the stored energy of the biasing element, has been found to be adequate to rapidly open the valve head. The condition or event to break the seal and trigger the second phase preferably comprises application of a force against the valve head in the open direction sufficient to open it, that is, sufficient to overcome the force resulting from the liquid pressure urging the valve head in the close direction.

According to another preferred aspect of the invention, the biasing element is configured and disposed to store the energy during the initial phase until the occurrence of the predetermined condition or event, and when the condition or event occurs (reducing net forces acting to close the valve head) to rapidly release the energy as a force directed against the valve head in a manner for rapidly moving or driving it to the fully open or nearly fully open position, independent of the actual speed of movement of the lever or other actuator. It has been found that, as a result of the reduction in, or counterbalancing of, the force of the fluid pressurization acting to close the valve, the movement of the valve head to the fully open or nearly fully open position can be achieved rapidly with application of only a relatively small force against the valve head in the opening direction. This is advantageous, as it also means that the amount of energy required to be stored for generating or adding to the opening force can be relatively small, and can in turn be generated by release of the stored energy. Also, this opening force can be increased or enhanced by further movement of the lever or other actuator in the opening direction. Similarly, the actuator movement for triggering the second or rapid open phase can be relatively easy and small, such that the operation of the invention can be effected with a fast, slow, continuous, interrupted, and/or uneven, actuator movements, with essentially equal superior results, namely, the ability to dispense a beverage with little or no break up and foaming.

According to another preferred aspect of the invention, the biasing element of the invention can comprise one or more mechanical springs, such as a compressions spring, tension spring, leaf spring, clock spring, torsion spring, and a spring bellows, having a capability for storing the required energy, and for rapidly releasing it in the form of a force acting against the valve head. The spring can be of metallic construction, a resilient polymer or polymers, or of a composite material. Alternatively, or additionally, the biasing element can comprise a fluid system, such as, but not limited to, a compressible gas piston system, and/or a system utilizing repelling magnets for generating the opening force. As representative, but non-limiting, values for a biasing element, a spring compressible to store a force of between about 1.5 and 2.0 pounds with 0.15 to 0.20 inches of compressive displacement, can be used to achieve a substantially reduced foaming condition when incorporated into a standard American beer faucet.

According to another preferred aspect of the invention, the biasing element can be incorporated into any of the elements of the valve assembly, including in or about the valve head; the valve stem; and the lever or other actuator.

As another preferred aspect of the invention, the biasing element can be configured and operable such that once open, the faucet is controllable to allow regulating the rate of beverage flow, and for allowing creation of a desired head of foam on the dispensed beverage.

As another feature of the invention, the biasing element or elements can be incorporated into a standard faucet, such as an American beer faucet, without outward changes to the appearance, such that the only noticeable difference between the faucet of the invention and an original faucet is the improved operation, that is, reduced beverage foaming regardless of the operator or manner of operation. The invention can also be incorporated into an existing faucet simply and inexpensively. In summary, using the present invention, experienced and inexperienced users with no instruction or training in operating the faucet can obtain similar, consistent low foaming pours for more productivity, less waste, and better customer satisfaction.

DETAILED DESCRIPTION OF THE INVENTION

Figure 1:
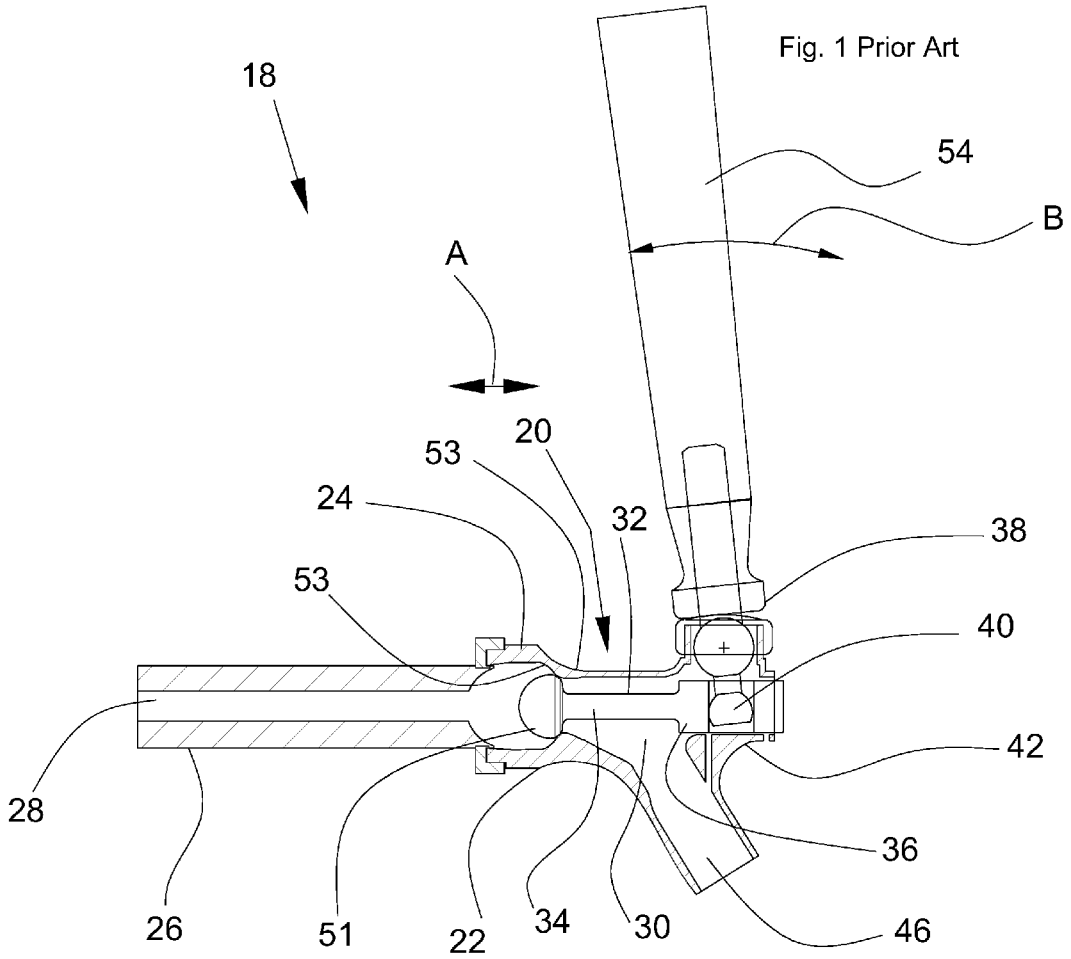
Fig. 1 Prior Art
FIG. 1 is a side view in partial section, of aspects of a representative beverage dispensing system including a prior art standard American draught beer faucet.

Referring now to the drawings, several embodiments of apparatus for controlling foaming and flow rate in a beverage dispensing system 18, e.g., for dispensing draught beer, are shown, like parts being identified by like numerals.

Referring to FIG. 1 first, a representative prior art standard American beer faucet 20 is illustrated, having a housing 22 including a threaded mounting end 24 adapted for threaded connection in a conventional manner to a container or line 26 which will contain beer 28. Housing 22 is oriented about horizontally, and defines a flow path 30 extending from mounting end 24 to an outlet or nozzle 46 through which the beer will be dispensed. Housing 22 includes an annular valve seat 53 extending about flow path 30 adjacent to mounting end 24. A barrel shape valve head 51 is disposed in flow path 30, between mounting end 24 and valve seat 52, and is configured and operable for forming a sealed condition with valve seat 52 when brought to bear thereagainst around the flow path. A resilient annular seal element or gasket 52 is disposed about valve head 51 for this purpose. An elongate valve stem 32 of one piece construction extends through flow path 30, and has a first end 34 which integrally connects to valve head 51, and an opposite second end 36. Valve stem 32 is supported by housing 22 for limited longitudinal, horizontal movement within flow path 30 sufficient for moving valve head 51 between a closed position (shown) with gasket 52 in sealed engagement with valve seat 53, and a fully open position spaced therefrom within mounting end 24, as denoted by arrow A, through a range of partially open positions. An actuator, which here is a conventional handle or lever 54, has a lower end 38 disposed in an opening of housing 22 and includes a ball 40 which is cooperatively received in a socket 42 in second end 36 of the valve stem 50. Lever 54 is pivotable about ball 40 as illustrated by arrow B for moving valve stem 32 longitudinally within housing 22 as denoted by arrow A, for moving valve head 51 between the open and closed positions, all in the well known manner. Faucet 20 configured as shown suffers from the shortcoming discussed above, namely, dispensing beer containing undesirable levels of foaming, when the faucet is not opened rapidly.

Figure 2:
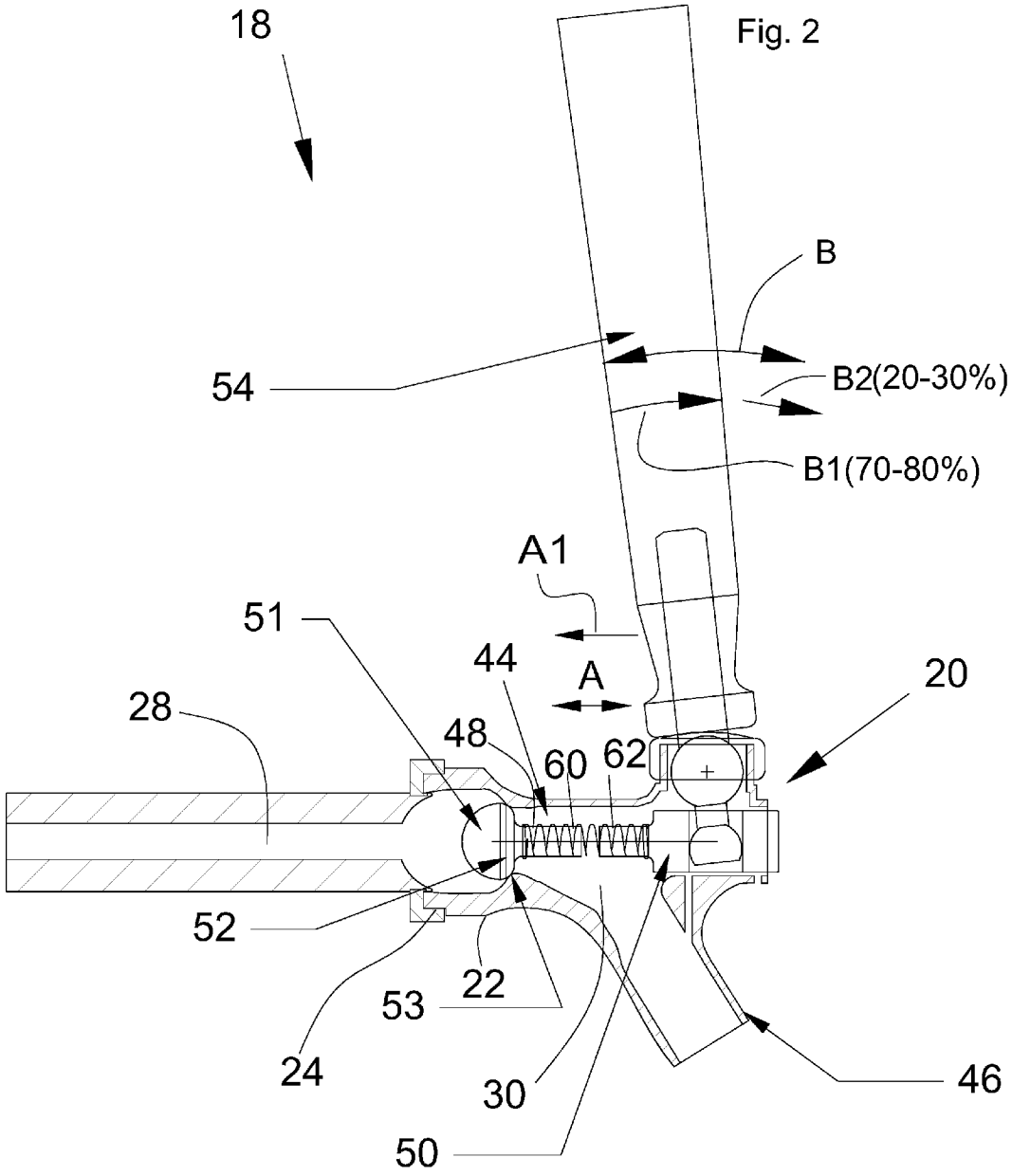
FIG. 2 is a side view of the system of FIG. 1, showing in partial section, a standard American draft beer faucet incorporating one embodiment of apparatus for reducing foaming while controlling flow rate, according to the invention.
Figure 3:
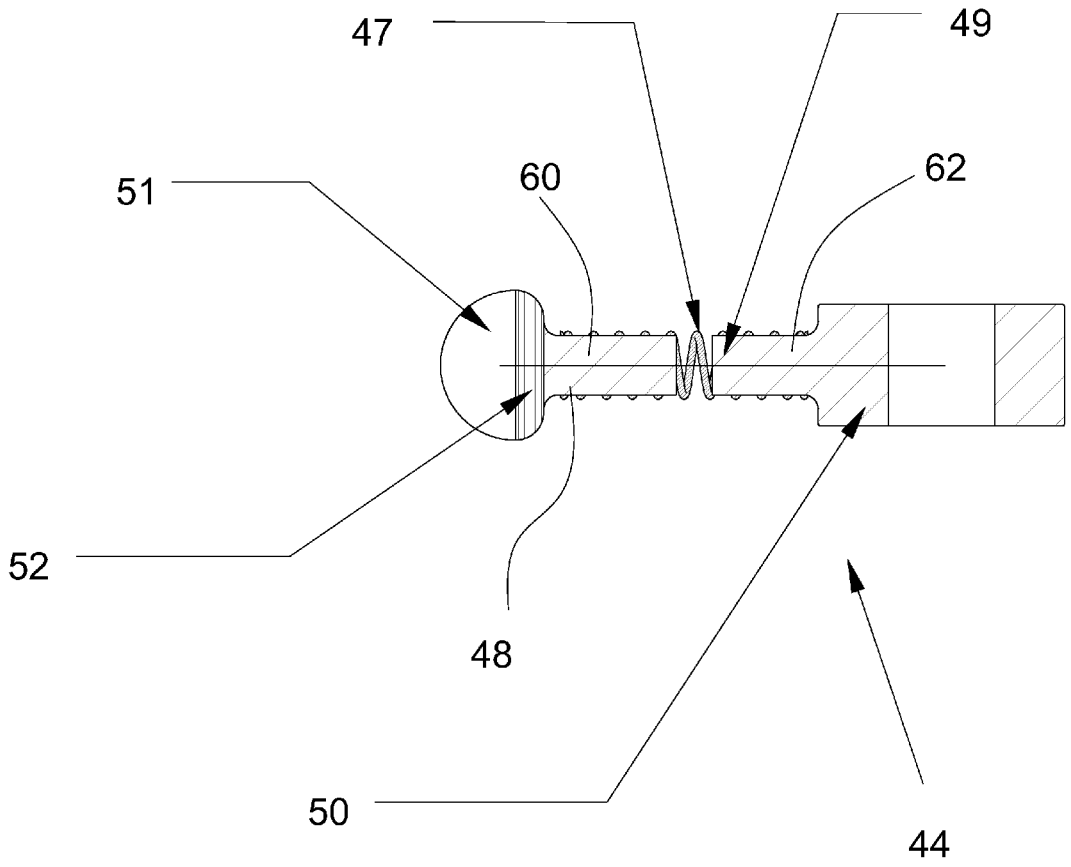
FIG. 3 is a side view of a biasing element of the system of FIG. 2.

Referring also to FIGS. 2 and 3, system 18 including a standard American beer faucet 20 is shown, modified according to the invention for overcoming the foaming shortcoming, while still allowing controlling flow rate of the dispensed beverage, which here is beer. Faucet 20 includes the same housing 22, having the same flow path 30 extending therethrough between mounting end 24 and nozzle 46. Valve seat 53 is configured and located the same, as is lever 54. Valve head 51 is also configured to include the same gasket 52 for forming a sealed condition with valve seat 53 when the valve head is in the closed position, in the above described manner.

Figure 10:
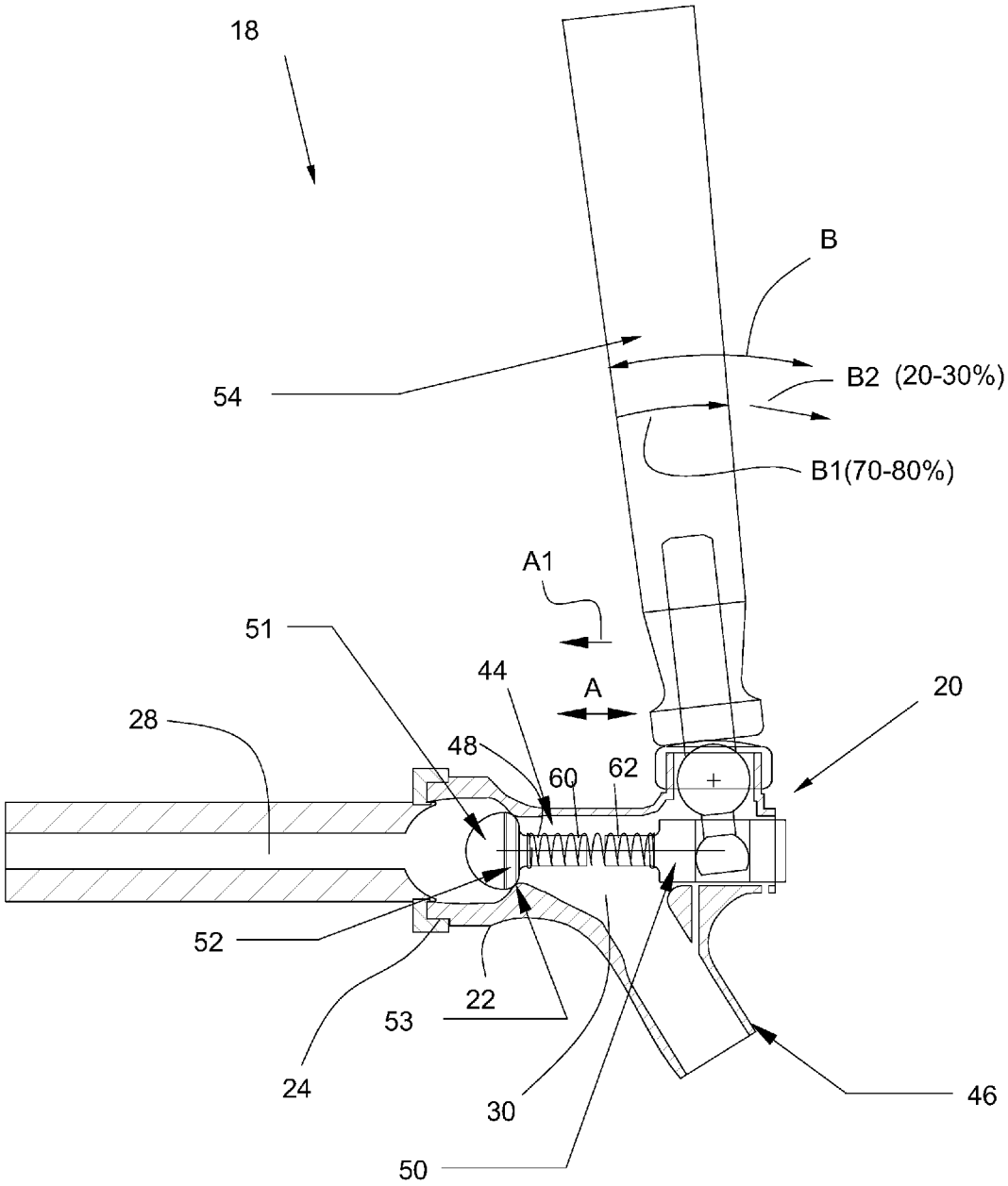
FIG. 10 is another side view in partial section, of the system and faucet of FIGS. 2 and 3, showing a valve stem having a different manner of retaining a biasing element in connection therewith, according to the invention.
Figure 11:
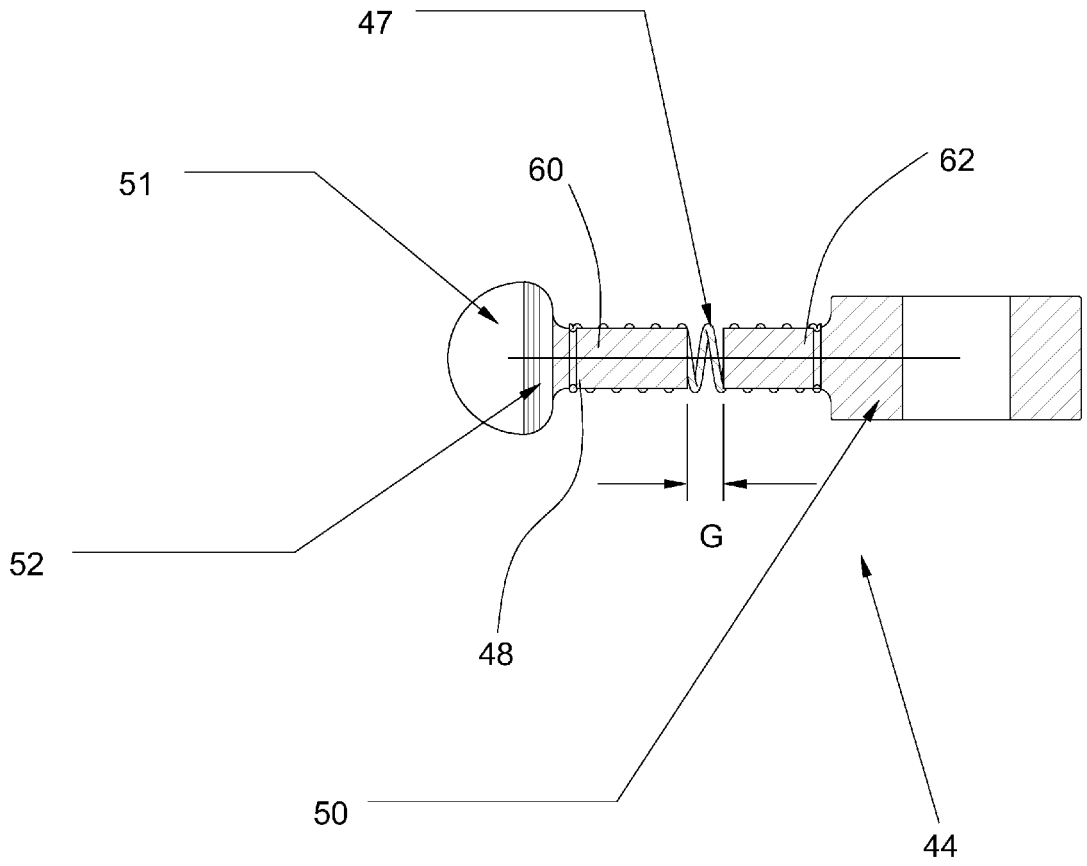
FIG. 11 is an enlarged side view of members of the apparatus of FIG. 10.
Figure 12:
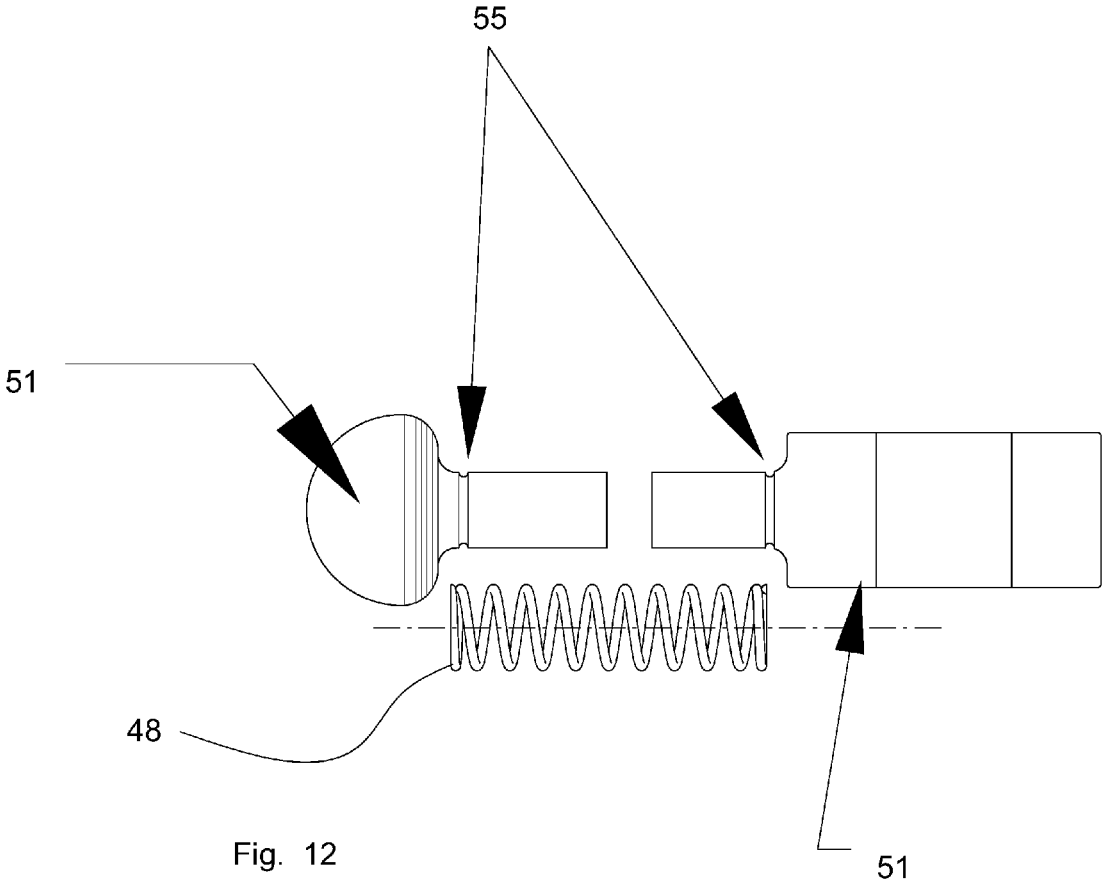
FIG. 12 is another enlarged side view of the members of the apparatus of FIG. 10, disassembled.

Faucet 20 of FIGS. 2 and 3 differs from that of FIG. 1, in the provision of a biasing element 44 comprising a flow regulating spring 47, a valve member 48, and a valve member pin 49, all incorporated as part of a valve stem 50 operable to provide an instant on of the flow of beer thus preventing the break-up of the beverage into foam. Essentially, valve stem 50 differs from valve stem 32 of a conventional American beer faucet by being of multiple piece construction, wherein first end 34 including head 51 is incorporated into separate valve member 48 carried on and connected to stem 50 by valve member pin 49, to allow relative longitudinal movement of member 48 and stem 50 in direction A, with pin 49 maintaining valve member 48 in alignment with valve seat 53. Also preferably, one end of spring 47 connects to valve member 48, and an opposite end connects to stem 50, for retaining valve member 48 in connection with stem 50. This connection can comprise, but is not limited to, a compressive friction fit that will be greater when the spring is in its free or uncompressed state and when elongated, compared to when in its compressed state or loaded, such that when the spring releases the stored energy and elongates from a compressed state to its free or uncompressed state, it will hold valve member 48 in connection to stem 50. (An alternative manner of retention of member 48 is illustrated in FIGS. 10 through 12).

When valve head 51 is in its closed position in sealed relation to seat 53, and lever 54 is in its closed position, a gap G (FIG. 3) will exist between the opposing ends of valve member 48 and stem 50, which is spanned by spring 47 and pin 49. This gap will have a width which is selected to allow a determined amount of compressive loading of spring 47 during opening of the faucet.

Referring also to FIGS. 4, 4A, 4B, 4C, and 4D, spring 47 is configured and operable during a first phase of operation of element 44 to be resiliently compressible or loadable for absorbing and storing energy exerted thereagainst by an initial movement of stem 50 as denoted by arrow A1 in the direction toward head 51, as effected by an initial range of pivotal movement of lever 54 in the direction B1, which is preferably selected to be, but not limited to, about 70 to 80 percent of the range of movement of the lever. This will result in a closing or substantial closing of gap G between the valve member 48 and stem 50. Once loaded, spring 47 can store this energy indefinitely, or it can be released by movement of lever in the reverse direction. The energy is stored in the same manner, irrespective of the speed of movement of the lever. Then, responsive to a predetermined condition or event, which is preferably an initial cracking open or breaking of the sealed condition, resulting from initial movement of valve head 51 from seat 53, and which will cause a reduction in the net force urging the valve head closed, spring 47, will automatically rapidly release or unload at least a portion of the stored energy as a force applied against valve member 48 in direction A1, as denoted by arrow F in FIG. 4A, for rapidly moving or driving the valve head 51 to the fully open position, or a substantially fully open position, in a second or rapid open phase.

As a non-limiting example, for a conventional beverage system, as represented by system 18, containing beer 28 normally pressurized to between about 5 psi and 25 psi, and using a standard American faucet 20, it has been found that a spring 47 configured to be compressible about 0.15 to 0.18 inch by application of a force of between about 1.5 pounds and 2.0 pounds, works well to store sufficient energy during the initial energy storing phase, for exerting the desired force against valve head 51 for rapidly moving it to its fully open position, or nearly the fully open position, during the rapid open phase, yet which will be just marginally insufficient by itself, for unseating valve head 51 from the valve seat.

To facilitate the above operability, namely the compression or loading of spring 47, valve member 48 and valve stem 50 are is configured and cooperable such that the initial gap G will allow about 0.15 to 0.18 inch of relative movement of valve member 48 and stem 50 in direction A, as guided by pin 49, which closes the gap between member 48 and stem 50. In this regard, pin will preferably have a length sufficiently greater than 0.18 inch so as to span this gap without disengaging from either member 48 or stem 50, and so as to be capable of maintaining those members in alignment for proper closing and sealing. As a non-limiting manner of achieving this, pin 49 will be received in holes 60 and 62 in the opposing ends of member 48 and stem 50, which holes will be sufficiently deep to allow the desired about 0.18 inch of compression of spring 47 and the closing of the gap.

Figure 4:
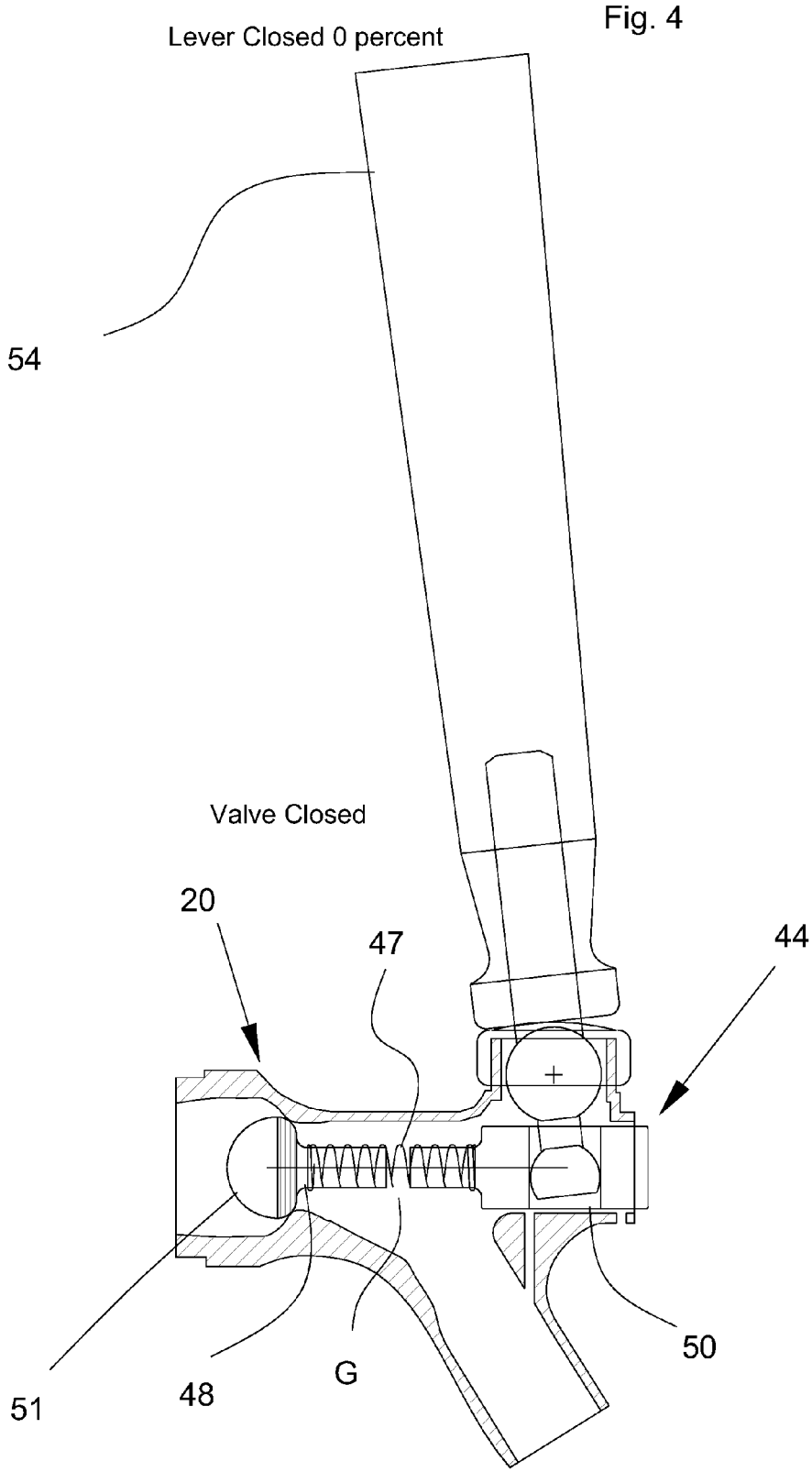
FIG. 4 is a side view in partial section, of the system and faucet of FIGS. 2 and 3, showing a representative first step of a sequence of operating states thereof.
Figure 4A:
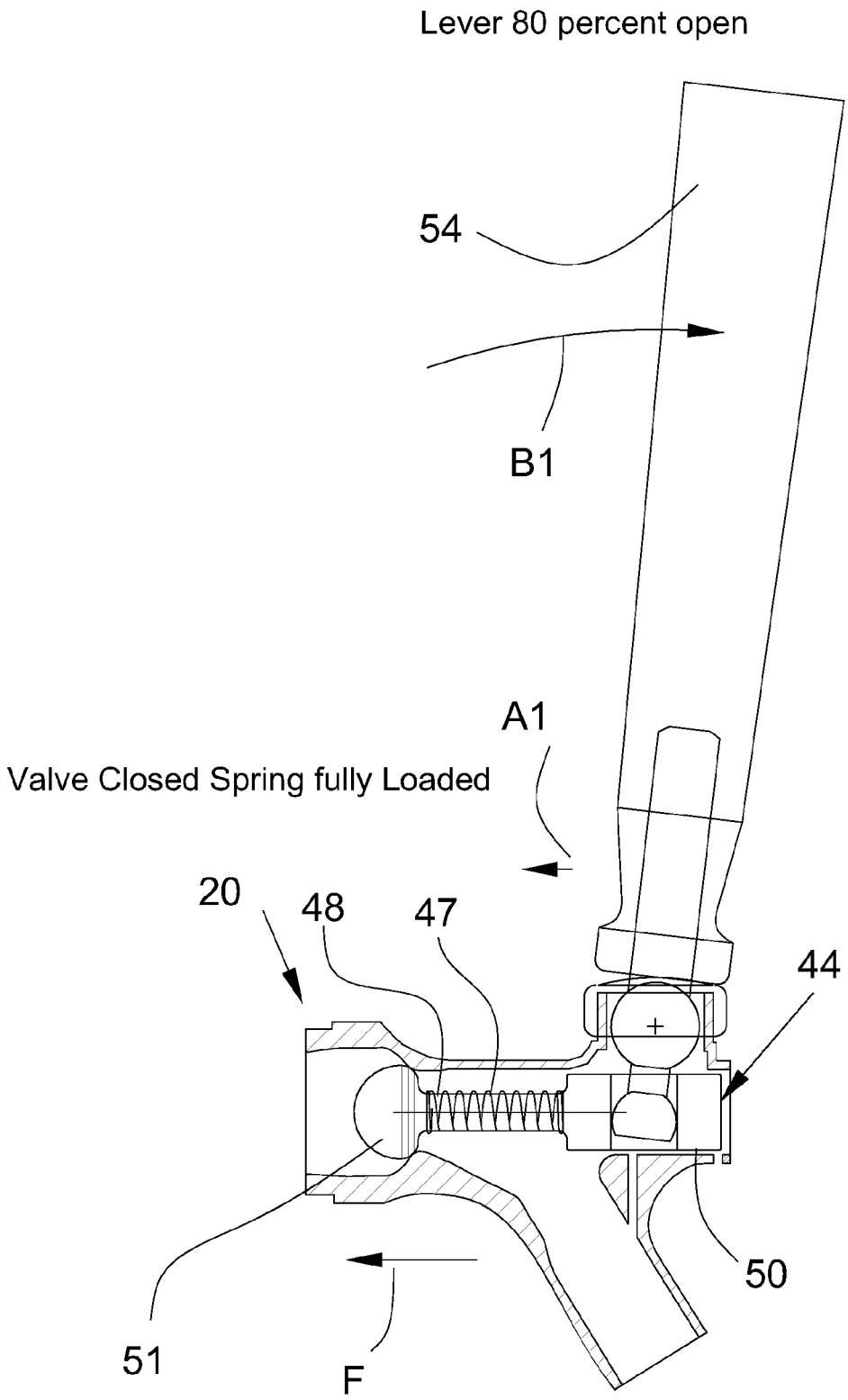
FIG. 4A is a side view in partial section, of the system and faucet of FIGS. 2 and 3, showing a representative second step of a sequence of operating states thereof.
Figure 4B:
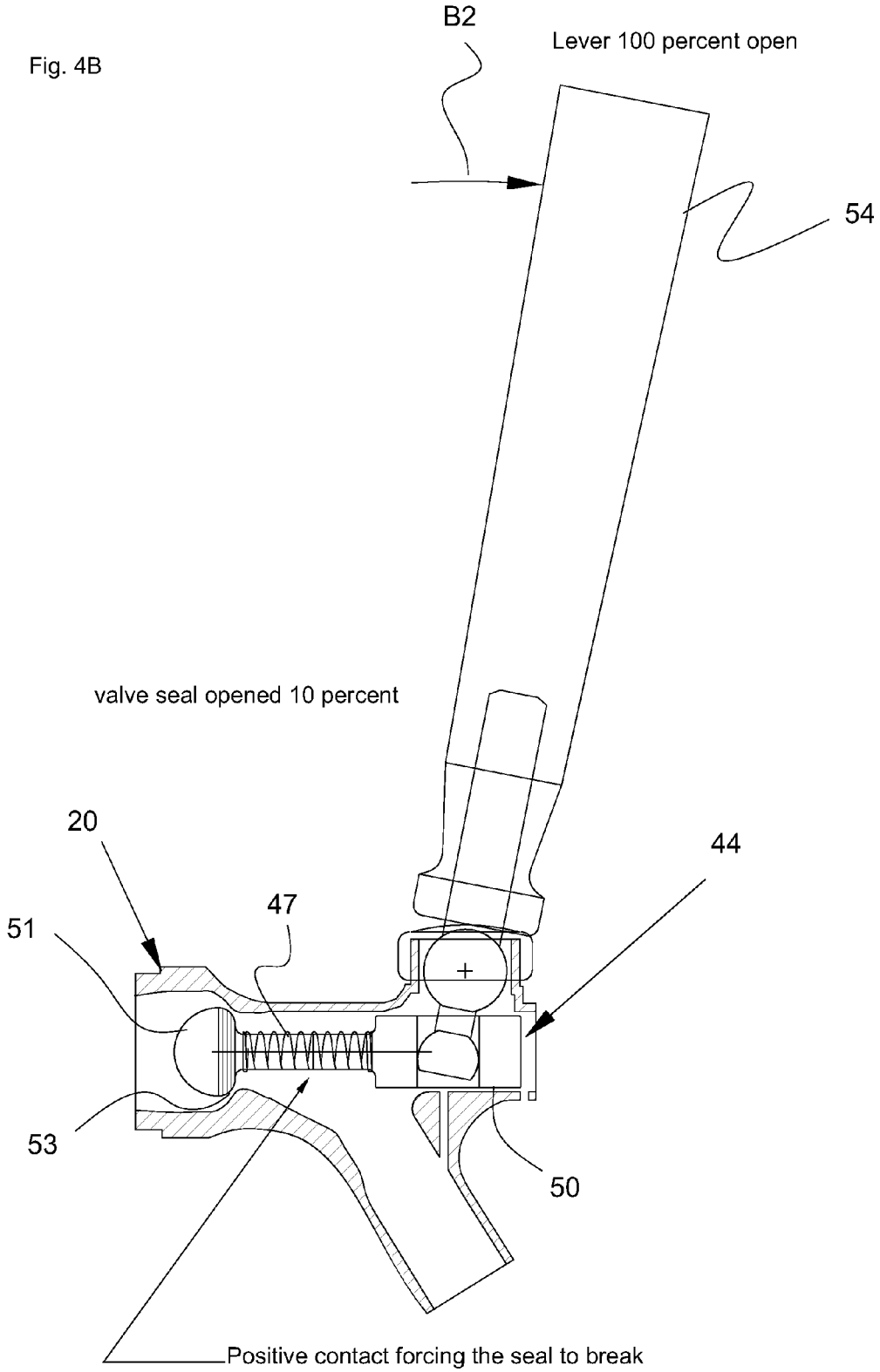
FIG. 4B is a side view in partial section, of the system and faucet of FIGS. 2 and 3, showing a representative third step of a sequence of operating states thereof.
Figure 4C:
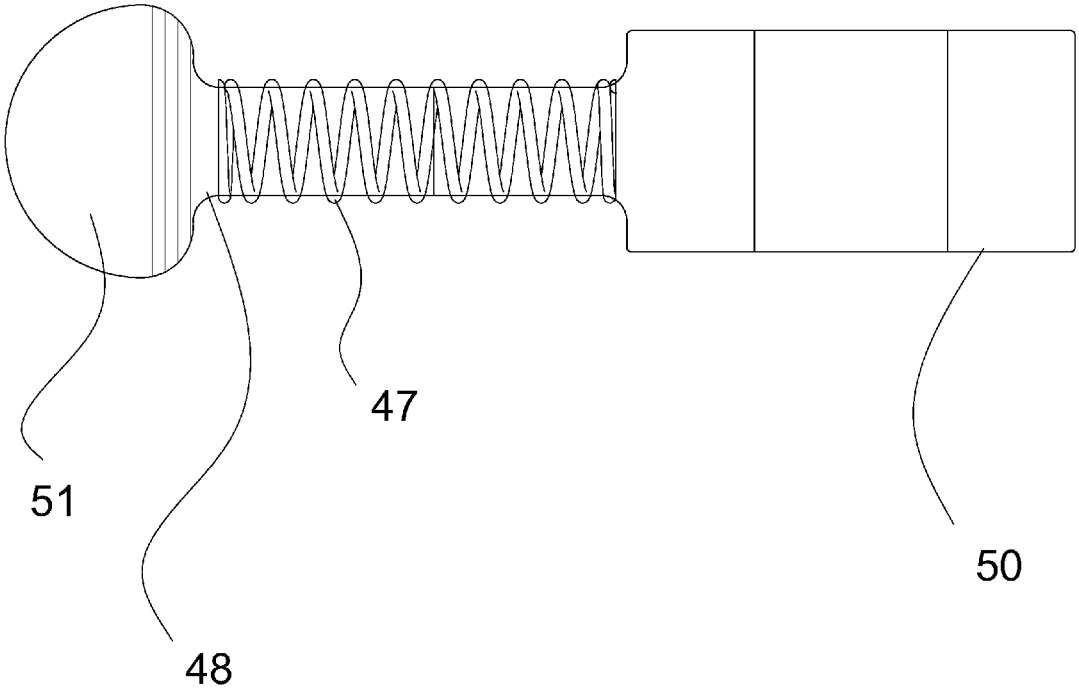
FIG. 4C is an enlarged side view showing members of a valve assembly of the system and faucet of FIG. 4B.
Figure 4D:
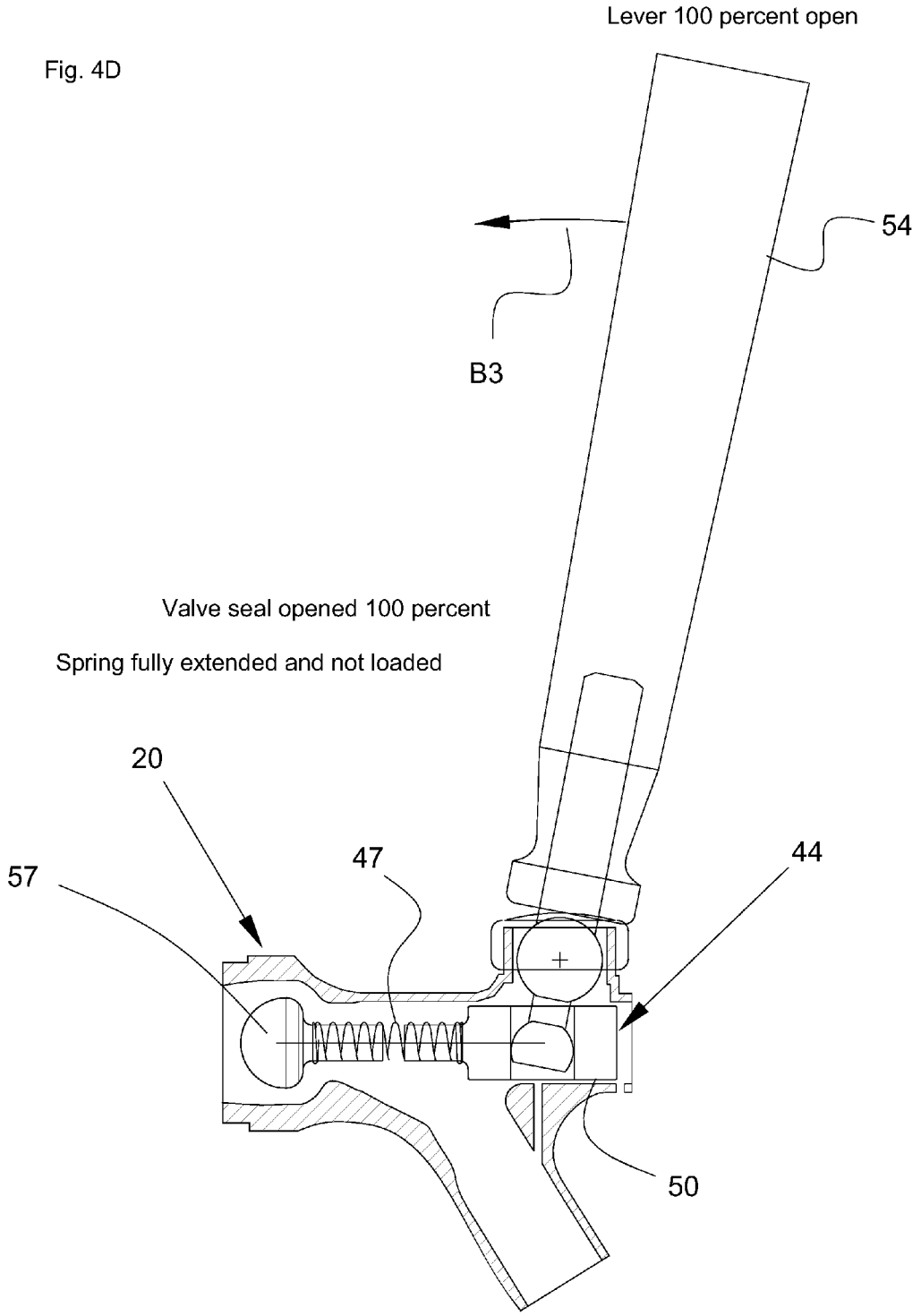
FIG. 4D is another side view in partial section, of the system and faucet of FIGS. 2 and 3, showing a subsequent step of a sequence of operating states thereof.

As one preferred triggering event, biasing element 44 can be configured and operable such that when spring 47 has been compressed by about the 0.18 inch amount, pin 49 will bottom out in both holes 60 and 62, closing the gap such that further movement of stem 50 in direction A1 can cause no further compression or loading of spring 47 with valve head 51 seated against valve seat 53. Alternatively, the holes can be deeper, and the opposing ends of the valve member 48 and the valve stem 50 brought together in abutment. In either instance, as a result, further movement of stem 50 in direction A1 with sufficient force, which will be assisted by unloading of spring 47, will initially crack open and break the seal between valve head 51 and seat 53, e.g., see FIG. 4B. This will allow the pressurized beer 28 to seep or begin to flow into the space between valve head 51 and seat 53, which will significantly reduce the closing pressure acting on the valve head, and/or more equally balance the opposing pressure conditions acting to open and close the valve, respectively. In particular, when valve head 51 is in sealed contact with valve seat 53, the pressure of the beverage will act only to urge valve head 51 in the closing direction (to the right in the FIGS.), but when spaced from valve seat 53 (moved to the left) some of the beverage will virtually immediately seep into the space between valve head 51 and valve set 53 and exert an opposite force against valve head 51 urging it in the open direction (to the left in the FIGS.) away from seat 53. In either event, the breaking of the seal between the valve head and the valve seat has been found to allow further movement in the open direction with application of only a small additional or externally applied force in the open direction. This force is automatically generated by the release of the energy stored in spring 47 (by decompression), and occurs occur almost or substantially instantaneously, and is facilitated or increased by further movement of valve stem 50 in the open direction A1, as effected by further movement of lever 54 in open direction, as denoted by arrow B2, and as illustrated by the sequence of FIGS. 4, 4A, 4B, and 4D, and graphically in FIG. 5. States of spring 47 and gap G, for the positions of FIGS. 4B and 4D, are illustrated in FIGS. 3 and 4C, respectively.

As an alternative trigger event or condition, biasing element 44 can be configured such that spring 47 will store sufficient energy as a result of compression to a similar extent, e.g., about 0.15 to 0.20 inch, to provide adequately stiffness or full compression, such that spring 47 itself and unassisted will move valve member 48 and head 51 sufficiently for breaking the seal with seat 53, with or without bottoming out of pin 49 or abutting contact between valve member 48 and valve stem 50.

Figure 5:
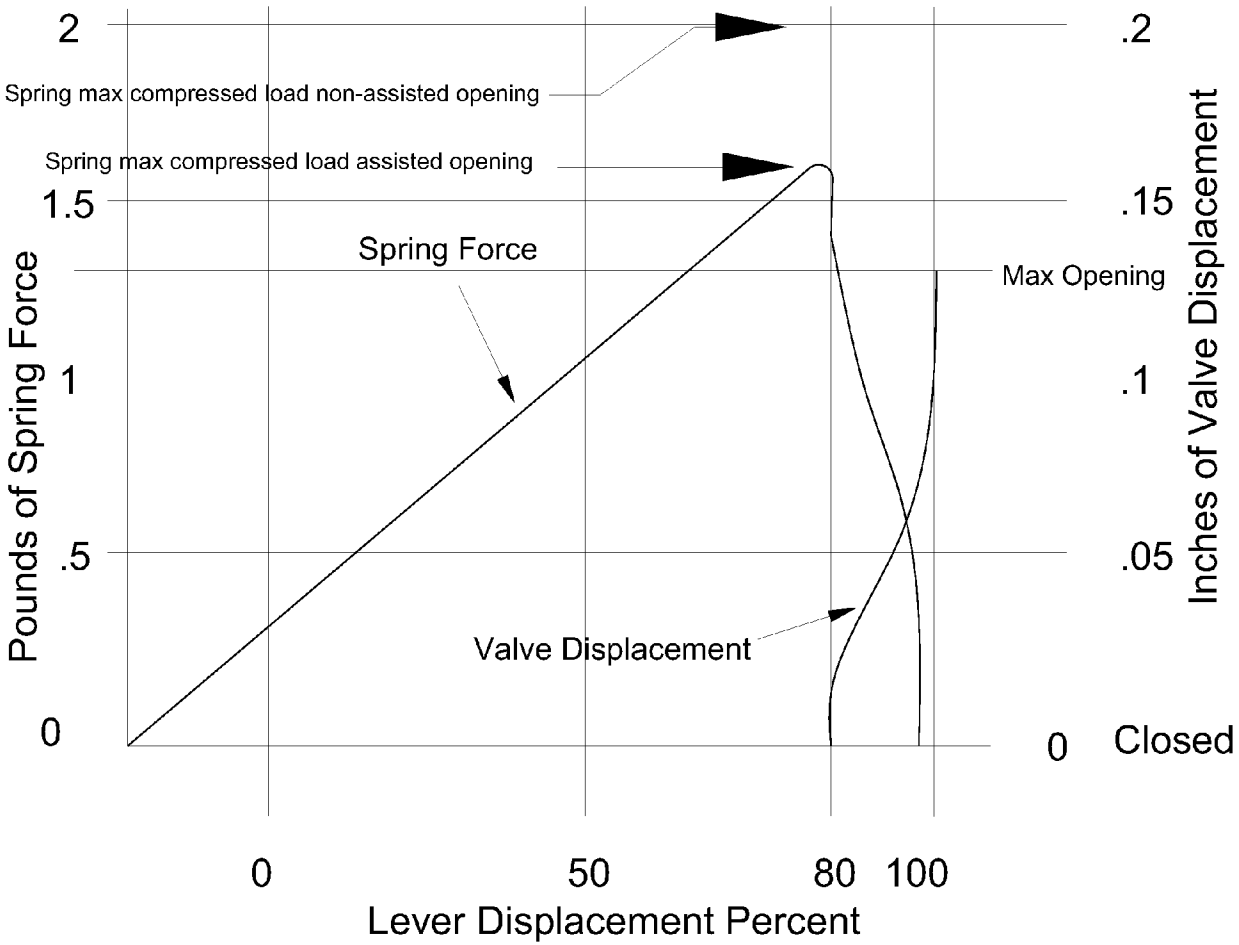
FIG. 5 is a graphical representation of operation of the faucet of FIGS. 2 through 4.

FIG. 5 graphically depicts the relationship of the loading of the spring, lever movement, and valve opening for the apparatus of FIGS. 2, 3, 4, and 4A-4D. As illustrated in FIG. 5, biasing element 44 can be configured such that spring 47 will store sufficient energy for propelling or driving valve member 48 and head 51 to about the fully open position, as a result of a movement of lever 54 through about 70 to 80 percent of its normal range of travel. The triggering event can then be a further movement of valve stem 50, member 48 and head 51, via a further movement of lever 54 in direction B1. This will cause full opening of the valve, without significant break up of the beverage flow or foaming of the poured beverage.

When it is desired to close faucet 20, or regulate flow of the beverage, lever 54 is moved in direction B3 (FIGS. 4D and 5) toward its closed position. Spring 47 will be in a free state or elongated as this occurs, and connect valve member 48 and valve head 51 to stem 50, such that stem 50 will pull member 48 and 51 back toward seat 53. This can be done in any manner and at any desired speed, much in the manner of operation of a conventional faucet, and can be used to place a desired head on a poured beverage as desired.

As another advantage of the invention, when it is desired to add more to an already partially filled beverage using the faucet 20 including a biasing element of the invention, it has been found that the faucet can be operated in the above described manner to add as much beer as desired, without appreciable foaming, if desired, and a head of foam of a desired extent can be added, by throttling back lever 54.

Figure 6:
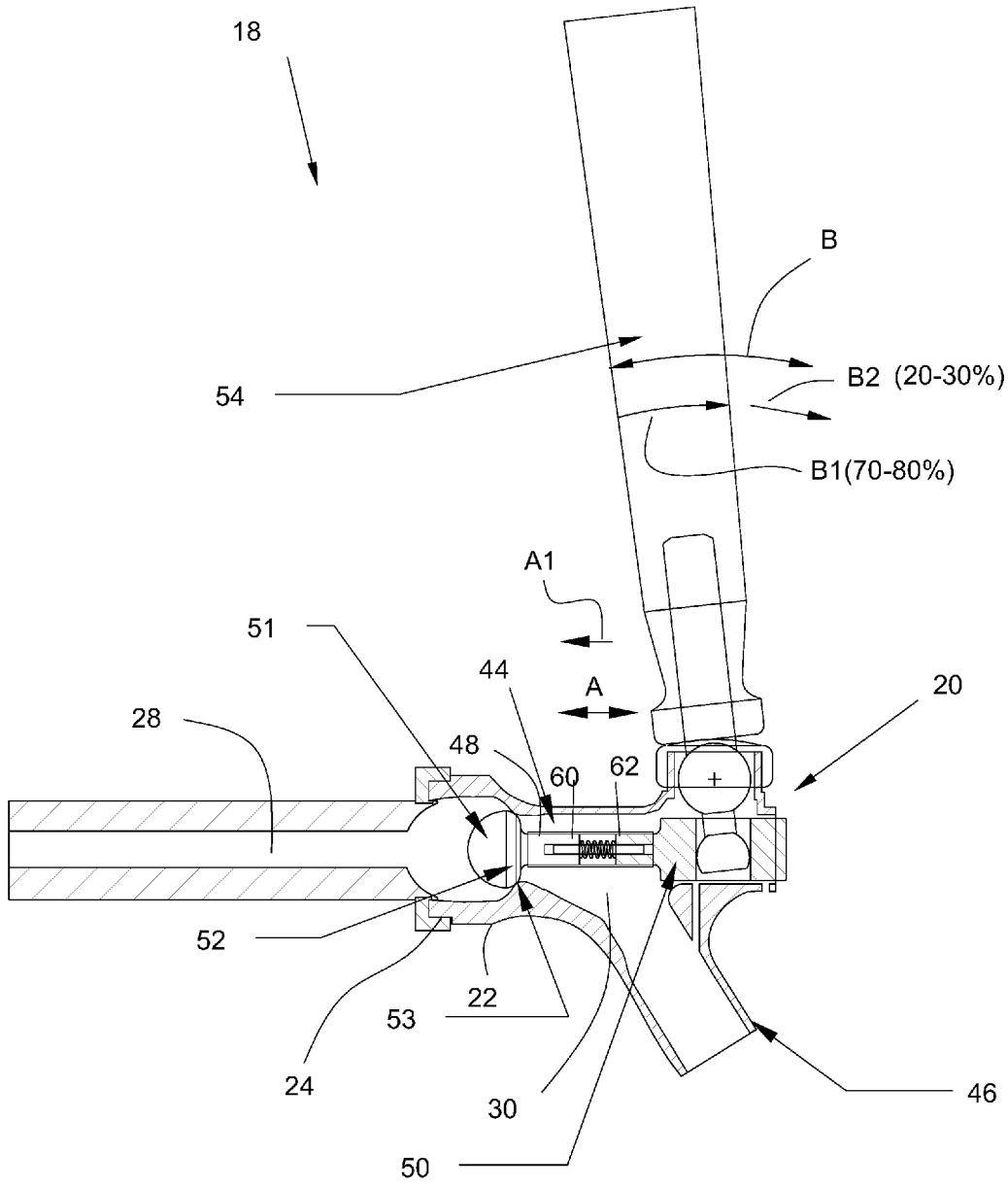
FIG. 6 is a side view if the system showing in partial section, a standard American draft beer faucet incorporating another embodiment of apparatus for reducing foaming while controlling flow rate according to the invention.
Figure 7:
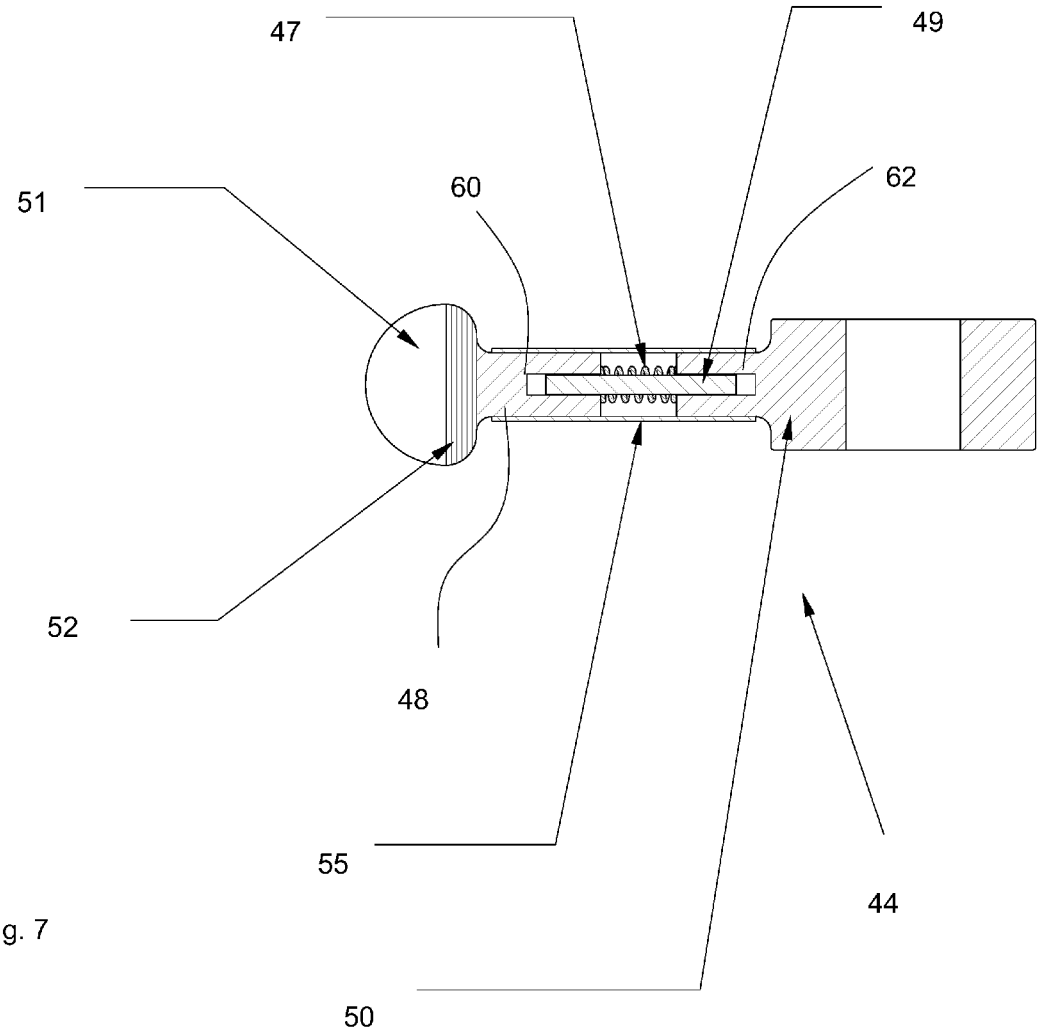
FIG. 7 is a side view of a biasing element of the system of FIG. 6.

In FIG. 6, faucet 20 of system 18 is illustrated including an alternative biasing element 44A of the invention. Referring also to FIG. 7, biasing element 44A, like element 44, utilizes a flow regulating spring 47, and a valve member 48, all incorporated as part of a valve stem 50 operable to move valve head 51 to provide an instant on of the flow of beer thus preventing the break-up of the beverage into foam. Here though, instead of extending about stem 50 and valve member 48, spring 47 is incorporated about pin 49 which extends into holes 60 and 62 in those members as before. Spring 47 and pin 49 span a gap G between the opposing ends of valve member 48 and stem 50 sized to allow the desired about 0.15 to about 0.18 inch of compression loading of spring 47, by movement of lever 54 by about amount B1 to effect movement of valve stem 50. Once compressed to this extent, with further movement of lever 54 (distance B2) stem 50 will contact member 48, pin 49 will bottom out, or spring 47 will not significantly compress further, such that valve member 48 will exert sufficient force against valve head 51 to break the seal with seat 53, and such that spring 47 will rapidly unload to rapidly move valve head 51 to the fully open or nearly fully open position, in a manner the same as described above and illustrated in FIGS. 4A-E. Thereafter, the poured beverage can be filled to a desired extent, and a desired head of foam added in the above described manner.

As another feature of biasing element 44A, an optional tubular rubber seal 55 of a resilient material, such as a soft natural or synthetic rubber, is shown extending about valve member 48 and stem 50, so as to span gap G between valve member 48 and stem 50, and thereby cover and compress with spring 47, or slide over members 48 and 50.

Figure 8:
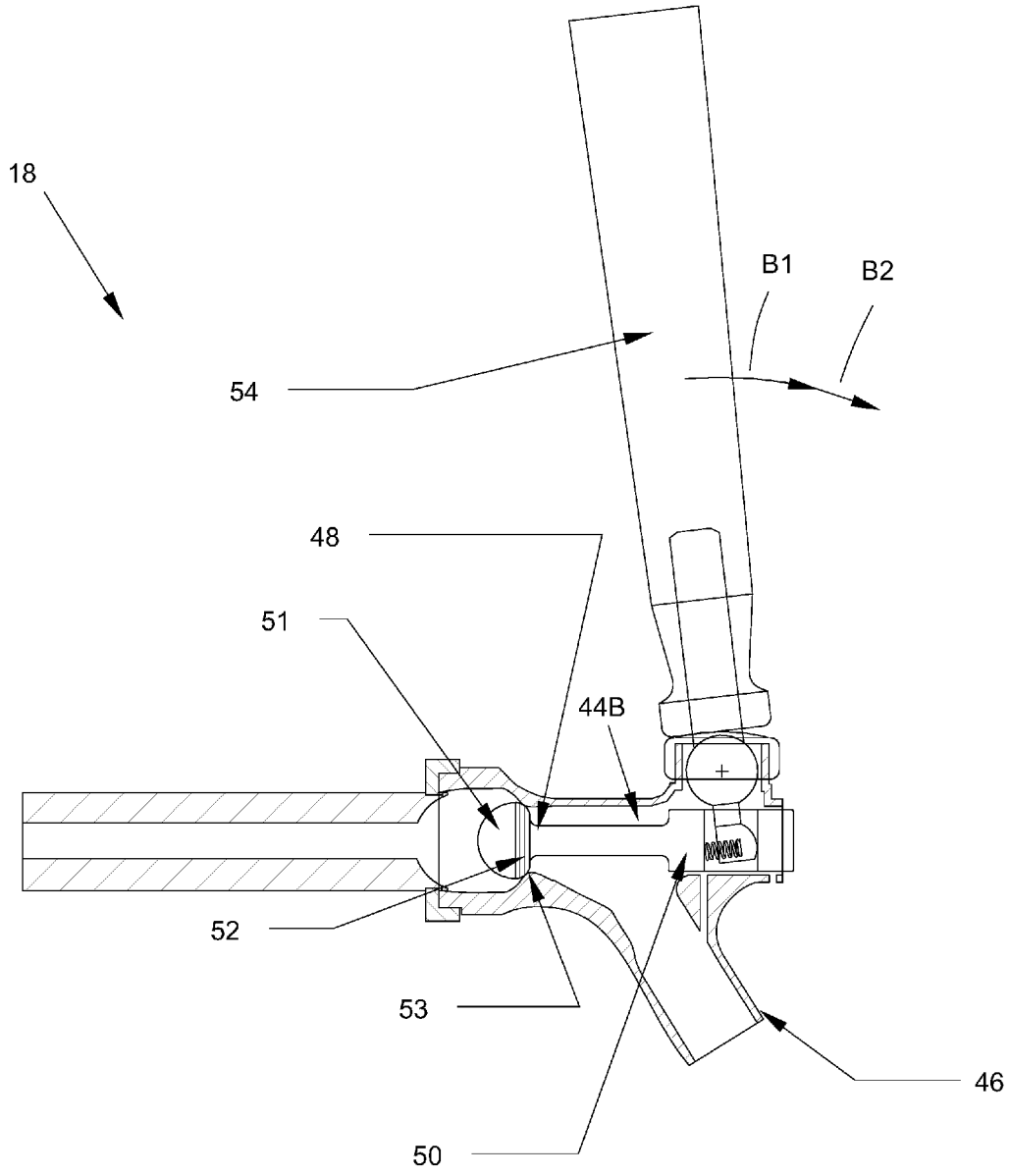
FIG. 8 is a side view of the system showing in partial section, a standard American draft beer faucet incorporating still another embodiment of apparatus for reducing foaming while controlling flow rate according to the invention.
Figure 9:
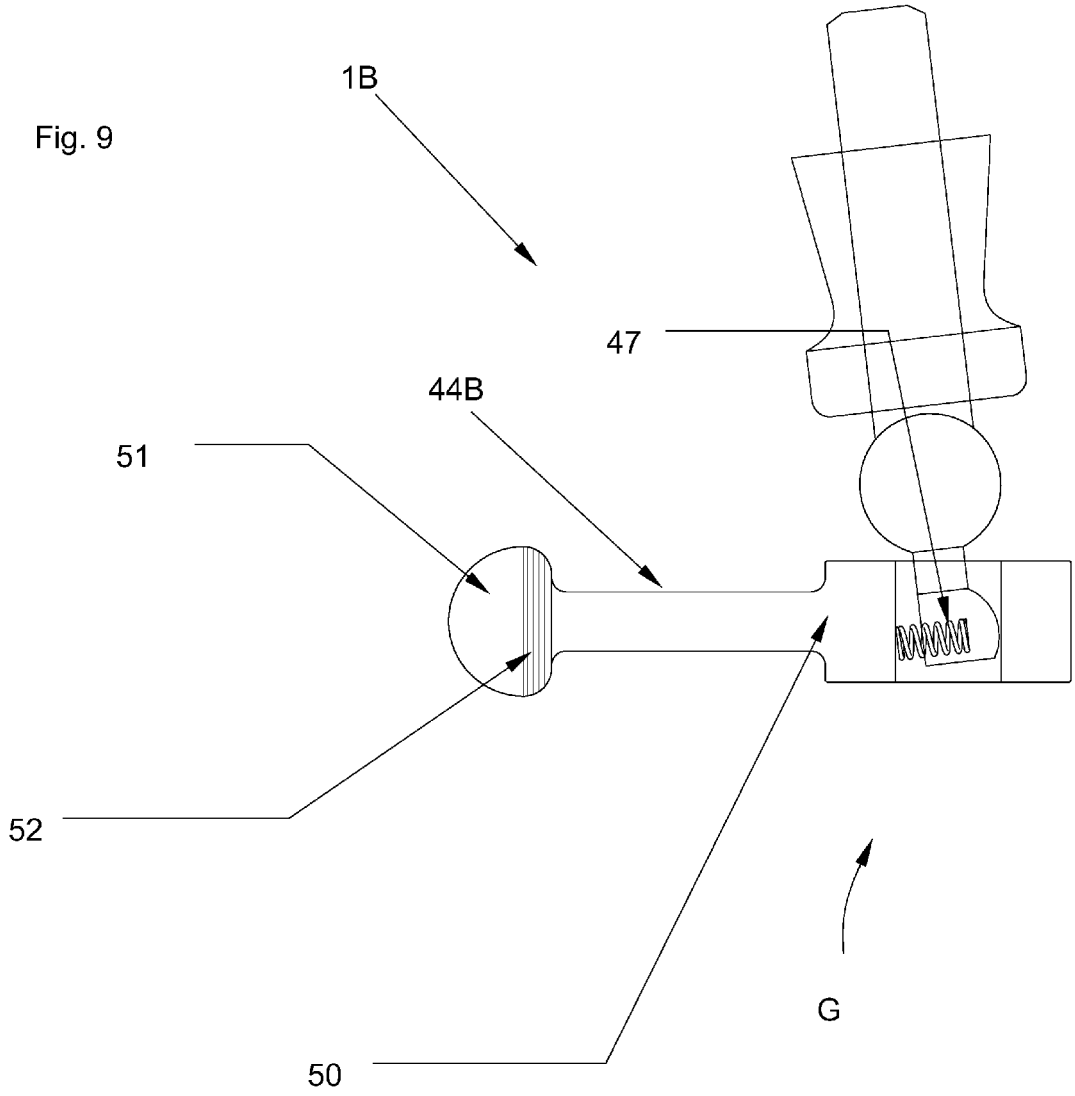
FIG. 9 is a side view of a biasing element of the system of FIG. 8.

In FIG. 8, faucet 20 of system 18 is illustrated including an alternative biasing element 44B of the invention. Biasing element 44B utilizes a flow regulating spring 47, disposed in connection with lower end 38 of lever 54 and valve stem 50, which is essentially of an original one piece construction instead of multiple piece construction just described. In this version, spring 47, in its free uncompressed or minimally compressed state, spans a gap G between a surface on the lower end of lever 54 and a bearing surface of valve stem 50, gap G having an extent about equal to the desired amount of compressive loading of spring 47, again about 0.15 to about 0.18 inch, again will be effected by movement of lever 54 by about amount B1. This gap can be conveniently created by modifying a standard lever by removing an amount of the end of the ball facing stem 50 equaling gap G. Once compressed to this extent, with further movement of lever 54 (distance B2) spring 47 will be compressed sufficiently and be sufficiently firm so as to exert sufficient force against valve stem 50, and thus valve head 51, to break the seal with seat 53, and such that spring 47 will rapidly unload to rapidly move valve head 51 to the fully open or nearly fully open position. Thereafter, the poured beverage can be filled to a desired extent, and a desired head of foam added in the above described manner, valve stem 50 being movable back to the closed position in the normal manner for this purpose and to close the valve.

Referring also to FIGS. 10, 11 and 12, biasing element 44 is shown incorporated into the faucet 20 of system 18 and again including a flow regulating spring 47, and a valve member 48, all incorporated as part of a valve stem 50 operable to move valve head 51 to provide an instant on of the flow of beer thus preventing the break-up of the beverage into foam, like parts of system 18 and faucet 20 again being identified by like numbers and described above. Here though, the opposite ends of spring 47 of the biasing element are configured to reside in grooves 55 about valve stem 50 and valve head 51 of valve member 48, to provide an alternative to frictional retention. Biasing element 44 will operate in the above discussed manner, with gap G being present when the faucet is closed and fully open, as explained above. A pin (not shown) will extend between holes 60 and 62 in valve stem 50 and valve head 51, respectively, for maintaining alignment, again, in the above discussed manner.

In light of all the foregoing, it should thus be apparent to those skilled in the art that there has been shown and described a beverage dispensing system including novel aspects. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A beverage dispensing system, comprising:

a dispensing faucet defining and enclosing a flow path, a valve head configured and supported in the flow path for movement between a closed position in sealed contact with a valve seat extending about the flow path for preventing flow of the beverage along the flow path, and a fully open position for allowing flow of the beverage past the valve seat;

an actuator in connection with the valve head and a biasing element, configured and cooperable such that an initial movement of the actuator when the valve head is in the closed position will automatically cause sufficient energy to be stored by the biasing element for moving the valve head to the open position, and a subsequent predetermined event will automatically cause the stored energy to be released in a manner to rapidly move the valve head from the closed position to the open position.

2. The beverage dispensing system of claim 1, wherein the predetermined event comprises a subsequent movement of the actuator to move the valve head from the closed position.

3. The beverage dispensing system of claim 1, wherein the biasing element comprises a spring.

4. The beverage dispensing system of claim 3, wherein the actuator comprises a lever disposed and configured to change a length of the spring by the initial movement.

5. The beverage dispensing system of claim 4, wherein the change of length of the spring comprises compressing the spring.

6. The beverage dispensing system of claim 5, wherein the predetermined event comprises further compressing the spring sufficiently for overcoming a force holding the valve head in the closed position.

7. The beverage dispensing system of claim 1, wherein the valve head is urged toward the closed position by a force exerted thereagainst by the beverage, and the biasing element is configured to be capable of storing a sufficient amount of the energy to overcome the force and to release the stored energy as an opposing force responsive to the predetermined event.

8. The beverage dispensing system of claim 7, wherein the opposing force has a value of between about 1.5 pounds and about 2 pounds.

9. The beverage dispensing system of claim 1, wherein the biasing element is disposed between the valve head and the actuator.

10. The beverage dispensing system of claim 9, wherein the biasing element is disposed about a valve stem extending between the valve head and the actuator.

11. The beverage dispensing system of claim 10, wherein the biasing element is disposed between the valve head and the actuator.

12. The beverage dispensing system of claim 1, wherein the flow path on one side of the valve seat contains a pressurized beverage which generates a force urging the valve head toward the closed position, and the biasing element is configured and operable responsive to the predetermined event to release the stored energy as a greater force in opposition to the force generated by the pressurized beverage, to rapidly move the valve head to the open position.

13. The beverage dispensing system of claim 12, wherein the predetermined event comprises a further movement of the actuator to force the valve head an initial distance from the closed position toward the open position to cause the beverage to enter a space between the valve seat and the valve head to exert a force against the valve head that will at least partially counteract the force urging the valve head toward the closed position.

14. A beverage dispensing system, comprising:

a dispensing faucet defining and enclosing a flow path extending to an outlet, and a valve seat extending about the flow path spaced from the outlet;

a valve assembly including a valve stem supporting a valve head in the flow path for movement between a closed position in sealed relation to the valve seat for preventing flow of the beverage past the valve seat, and an open position spaced from the valve seat for allowing flow of the beverage therepast to the outlet, the valve head being configured such that the beverage will exert a force thereagainst urging the valve head toward the closed position, and when the valve head is in the open position the beverage will also exert a second force thereagainst opposite the force urging the valve head toward the closed position; and an actuator disposed and configured for movement relative to the housing;

characterized by a biasing element being configured to cooperate with the actuator and the valve assembly such that a predetermined first movement of the actuator will load the biasing element with sufficient energy to overcome the force urging the valve head toward the closed position, and such that a subsequent predetermined second movement of the actuator will cause the biasing element to release the energy in a manner so as to initially move the valve head from the closed position to allow the second force to be exerted against the valve head, and thereafter the energy released by the biasing element will cooperate with the second force to move the valve head to the open position.

15. The beverage dispensing system of claim 14, further characterized in that the biasing element will release the energy as a force exerted against the valve head to move the valve head to the open position.

16. The beverage dispensing system of claim 14, further characterized by the valve stem having a portion connected to the valve head and a separate portion disposed in contact with the actuator, and the biasing element is disposed between the portions.

17. The beverage dispensing system of claim 16, further characterized by the biasing element comprising a spring, and the first predetermined movement comprising deforming the spring to load the spring with the energy.

18. The beverage dispensing system of claim 16, further characterized by the portions of the valve stem and the actuator being configured such that the portions of the valve stem will be brought together by the predetermined first movement of the actuator, and such that the second movement of the actuator will cause the valve stem to move the valve head an initial distance from the valve seat such that the beverage will enter a space therebetween so as to exert the second force against the valve head, and the energy will be rapidly released as a force acting against the valve head to move the valve to the open position.

19. A pressurized beverage dispensing faucet, comprising:

a valve assembly disposed in a flow path from a source of the pressurized beverage to an outlet for dispensing the beverage, including a valve head configured to be urged by a force generated by the beverage into sealed contact with a valve seat disposed about the path for preventing flow of the beverage through the valve seat, and movable though a limited range of open positions spaced from the valve seat for allowing flow of the beverage;

an actuator disposed and configured to be movable for moving the valve stem from the sealed contact with the valve seat; and a biasing element disposed in connection with the valve stem or the actuator configured for automatically immediately moving the valve head through the limited range of open positions, responsive to movement of the valve head from the sealed contact with the valve seat, and independently of any further movement of the actuator or speed thereof.

20. The faucet of claim 19, wherein the biasing element is configured and operable to be loaded with energy by the movement of the actuator by a predetermined first extent, and to automatically release the energy to move the valve head fully through the range of open positions by any further movement of the actuator for moving the valve head farther from the valve seat.

21. The faucet of claim 20, wherein the biasing element comprises a spring disposed between the actuator and the valve stem.

22. The faucet of claim 20, wherein the valve stem comprises first and second relatively movable members, and the biasing element comprises a spring disposed between the members and compressible by the relative movement of the members to load with the energy.

* * * * *